US008628595B2

(12) United States Patent
Von Kossak-Glowczewski et al.

(10) Patent No.: US 8,628,595 B2
(45) Date of Patent: Jan. 14, 2014

(54) BURNER MUFFLE FOR A GASIFICATION REACTOR

(75) Inventors: Thomas Paul Von Kossak-Glowczewski, Gummersbach (DE); Henricus Gijsbertus Van Schie, Amsterdam (NL); Johannes Gerardus Maria Schilder, Amsterdam (NL)

(73) Assignee: Shell Oil Company, Houston, TX (US)

( * ) Notice: Subject to any disclaimer, the term of this patent is extended or adjusted under 35 U.S.C. 154(b) by 1505 days.

(21) Appl. No.: 12/014,655

(22) Filed: Jan. 15, 2008

(65) Prior Publication Data

US 2009/0049747 A1 Feb. 26, 2009

Related U.S. Application Data

(60) Provisional application No. 60/887,103, filed on Jan. 29, 2007.

(30) Foreign Application Priority Data

Jan. 17, 2007 (EP) ..... 07100650

(51) Int. Cl.
*B01J 7/00* (2006.01)

(52) U.S. Cl.
USPC ..... 48/61

(58) Field of Classification Search
USPC ..... 48/62 R, 67
See application file for complete search history.

(56) References Cited

U.S. PATENT DOCUMENTS

| | | | | |
|---|---|---|---|---|
| 4,202,672 A | | 5/1980 | Schuurman | 48/77 |
| 4,510,874 A | | 4/1985 | Hasenack | 110/347 |
| 4,523,529 A | | 6/1985 | Poll | 110/263 |
| 4,802,894 A | * | 2/1989 | Usami et al. | 48/77 |
| 4,818,252 A | | 4/1989 | Kohenen et al. | 48/67 |
| 4,959,080 A | | 9/1990 | Sternling | 71/92 |
| 5,950,572 A | * | 9/1999 | Heering et al. | 122/379 |

FOREIGN PATENT DOCUMENTS

| | | | |
|---|---|---|---|
| DE | 2425962 | 12/1975 | C10J 3/48 |
| EP | 254830 | 2/1988 | C10J 3/48 |
| GB | 692732 | 12/1951 | |
| GB | 1501284 | 12/1978 | C10J 3/74 |
| JP | 10-281414 | 10/1998 | |

OTHER PUBLICATIONS

European Search Report dated Jul. 17, 2007.

"Gasification" by Christofer Higman and Maarten van der Burgt, 2003, Elsevier Science, Burlington MA, pp. 118-120.

* cited by examiner

*Primary Examiner* — Imran Akram

(57) ABSTRACT

A gasification reactor comprising a pressure shell, a reaction zone partly bounded by a vertically oriented tubular membrane wall, a horizontally directed burner having a burner head at which, in use, a combustion flame is discharged into said reaction zone, said burner protruding into the vertical wall part of the membrane wall via a burner muffle, said burner muffle comprising several vertically oriented, concentric and interconnected rings, wherein each successive ring has an increasing diameter relative to the preceding ring resulting in that the burner muffle has a muffle opening for the burner head at one end and a larger opening at its other—flame discharge—end, the rings comprising a conduit having an inlet end for a cooling medium and an outlet for used cooling medium and wherein the muffle opening for the burner head is located between the pressure shell and the membrane wall and wherein the burner muffle protrudes into the reaction zone.

9 Claims, 3 Drawing Sheets

BURNER MUFFLE FOR A GASIFICATION REACTOR

This application claims the benefit of European Application EP 07100650.6 filed Jan. 17, 2007 and U.S. Provisional Application No. 60/887103 filed Jan. 29, 2007.

BACKGROUND OF THE INVENTION

The invention is directed to a gasification reactor comprising a pressure shell, a reaction zone partly bounded by a vertically oriented tubular membrane wall, a horizontally directed burner having a burner head at which, in use, a combustion flame is discharged into said reaction zone, said burner protruding into the vertical wall part of the membrane wall via a burner muffle.

Such a gasification reactor is described in U.S. Pat. No. 4,202,672. This publication describes a coal gasification reactor provided with a pressure shell, a reaction zone and a membrane wall, which partly defines the reaction zone. The tubular shaped membrane wall comprises interconnected conduits in which evaporating cooling water is present.

In U.S. Pat. No. 4,959,080 a coal gasification process is described which may be performed in a gasification reactor as above. This publication describes that a layer of slag will form on the membrane wall during gasification of coal. This layer of slag will flow downwards along the inner side of the membrane wall.

The Shell Coal Gasification Process also makes use of a gasification reactor comprising a pressure shell and a membrane walled reaction zone according to "Gasification" by Christofer Higman and Maarten van der Burgt, 2003, Elsevier Science, Burlington Mass., pages 118-120. According to this publication the Shell Coal Gasification Process is typically performed at 1500° C. and at a pressure of between 30 and 40 bar. The horizontal burners are placed in small niches according to this publication.

Applicants have successfully performed the Shell Coal Gasification Process at the lower end of the above disclosed pressure range. It is however desirable to operate a gasification reactor at higher pressures because, for example, the size of the reactor (diameter and/or length) can then be reduced while achieving the same capacity. A reduced diameter of the gasification reactor provides a smaller circumferential area for the slag running down the vertical membrane wall. At an equal reactor throughput the thickness of the fluid slag layer is increased thereby. This effect is even bigger by using high-ash feedstocks. It has been found that with increasing gas pressures and reduced reactor diameter, slag ingresses into the burner muffles. This slag deflects the oxygen/coal flame towards the metallic muffle walls, which causes extremely high heat fluxes. In combination with the higher overall surface temperatures steam blankets can be formed on the water cooling side, resulting in that locally no adequate cooling exists. This in turn may result in that at such locations the metal of the membrane wall melts away.

U.S. Pat. No. 4,818,252 describes a burner muffle as present in a membrane wall of a gasification reactor. The burner muffle itself can be adapted in design depending on the gasification conditions. The design comprises a vertical cooled shield comprised of interconnected concentric tubes around an opening for a gasification burner. This vertical concentric shield can be placed at different horizontal positions, i.e. closer to or further away from the membrane wall.

The burner muffle of U.S. Pat. No. 4,818,252 is however vulnerable to slag ingress, when the gasification reaction is conducted under conditions wherein a thick layer of viscous liquid slag forms on the inside of the membrane wall. In such a situation the slag will flow in front of the burner head and disturb the combustion. U.S. Pat. No. 4,818,252 discloses a slag deflector in FIG. 14 to avoid that slag covers the burner head. However, this design is not adequate to cope with thick layers of slag.

It would therefore be an advancement in the art to provide a gasification reactor as described above, which can operate at the higher pressures and which can either avoid the large heat fluxes or alternatively at least minimize the adverse consequences of such heat fluxes. It would be a further advancement to provide a gasification reactor, which can operate at high slagging conditions.

SUMMARY OF THE INVENTION

The present invention provides a gasification reactor comprising a pressure shell, a reaction zone partly bounded by a vertically oriented tubular membrane wall, a horizontally directed burner having a burner head at which, said burner protruding into the vertical wall part of the membrane wall via a burner muffle, said burner muffle comprising several vertically oriented, concentric and interconnected rings, wherein successive rings have an increasing diameter relative to preceding rings resulting in that the burner muffle has a muffle opening for the burner head at one end and a larger opening at its other—flame discharge—end, the rings comprising a conduit having an inlet end for a cooling medium and an outlet for used cooling medium and wherein the muffle opening for the burner head is located between the pressure shell and the membrane wall and wherein the burner muffle protrudes into the reaction zone.

DETAILED DESCRIPTION OF THE DRAWINGS

DETAILED DESCRIPTION OF THE INVENTION

Applicants have found that by providing adequate cooling to the surfaces of the burner muffle as achieved by the claimed gasification reactor a robust design is obtained which can also operate at the higher gasification pressures, preferably at a pressure of above 30 bar, more preferably at a pressure of above 35 bar and below 70 bar. Applicants have further found that the protrusion is beneficial to avoid slag from entering the burner muffle. It is believed that by avoiding slag from depositing on the surface of the muffle lower local heat fluxes occur and thus an even more robust design is obtained.

Additionally, it has been found that the operational temperature range for a gasification reactor for a specific ash containing feedstock can be widened by using the protruding burner muffle. This is beneficial in two ways: a) the operation of the gasification reactor is easier, safer and more reliable and b) by operating at the lower range of the widened operating window the process consumes less oxygen and is thereby more efficient.

The operational temperature range of the gasification reactor is dictated by the viscosity of the fluid slag running down the membrane wall. At high temperatures the viscosity is low and deflection around the burner muffle is easier. At lower temperatures the viscosity is higher and a proper deflection around the burner muffle is required. This is now achieved with the protruding burner muffle as present in the reactor according to the present invention.

The gasification reactor according to the present invention is suitably used for gasification of at least an ash containing solid carbonaceous feeds, such as for example coal, biomass, for example wood and agricultural wastes, or liquid carbonaceous feeds, such as for example tar sand fractions and other bituminous oils. The ash will result in a layer of slag forming on the membrane wall. In the gasification reactor additional feeds may also be gasified, which feeds do not necessarily contain ash.

Figure 1:
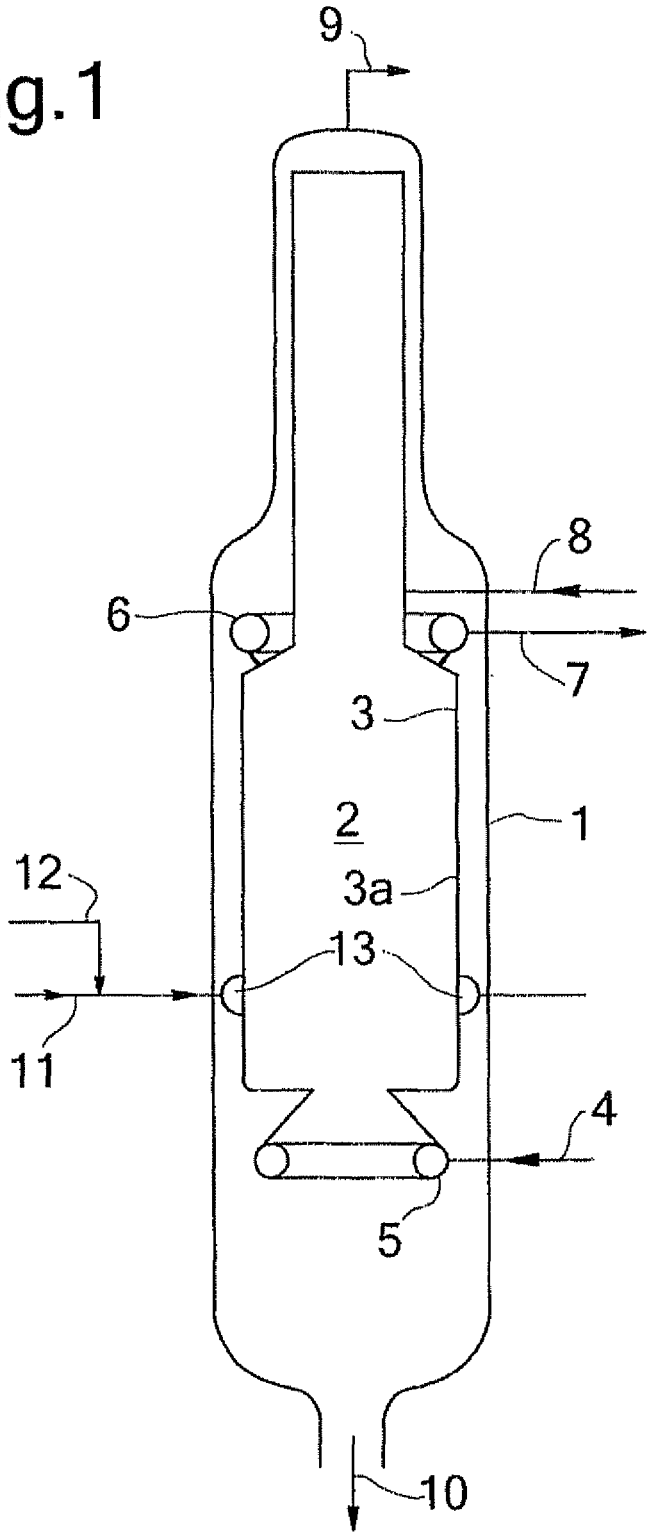
FIG. 1 is a schematic illustration of a gasification reactor according to the invention.
Figure 2:
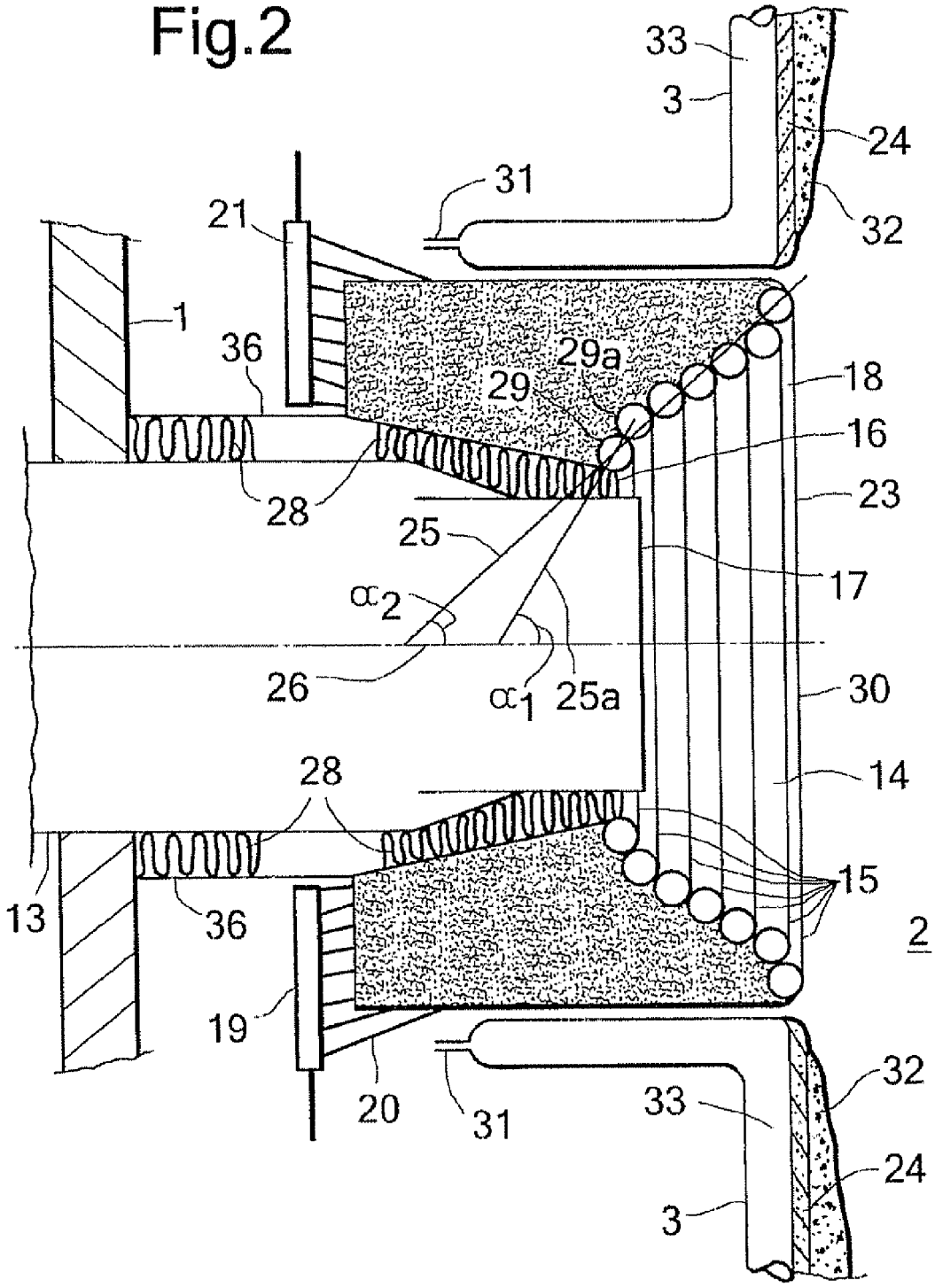
FIG. 2 illustrates a burner muffle not according to the invention.
Figure 3:
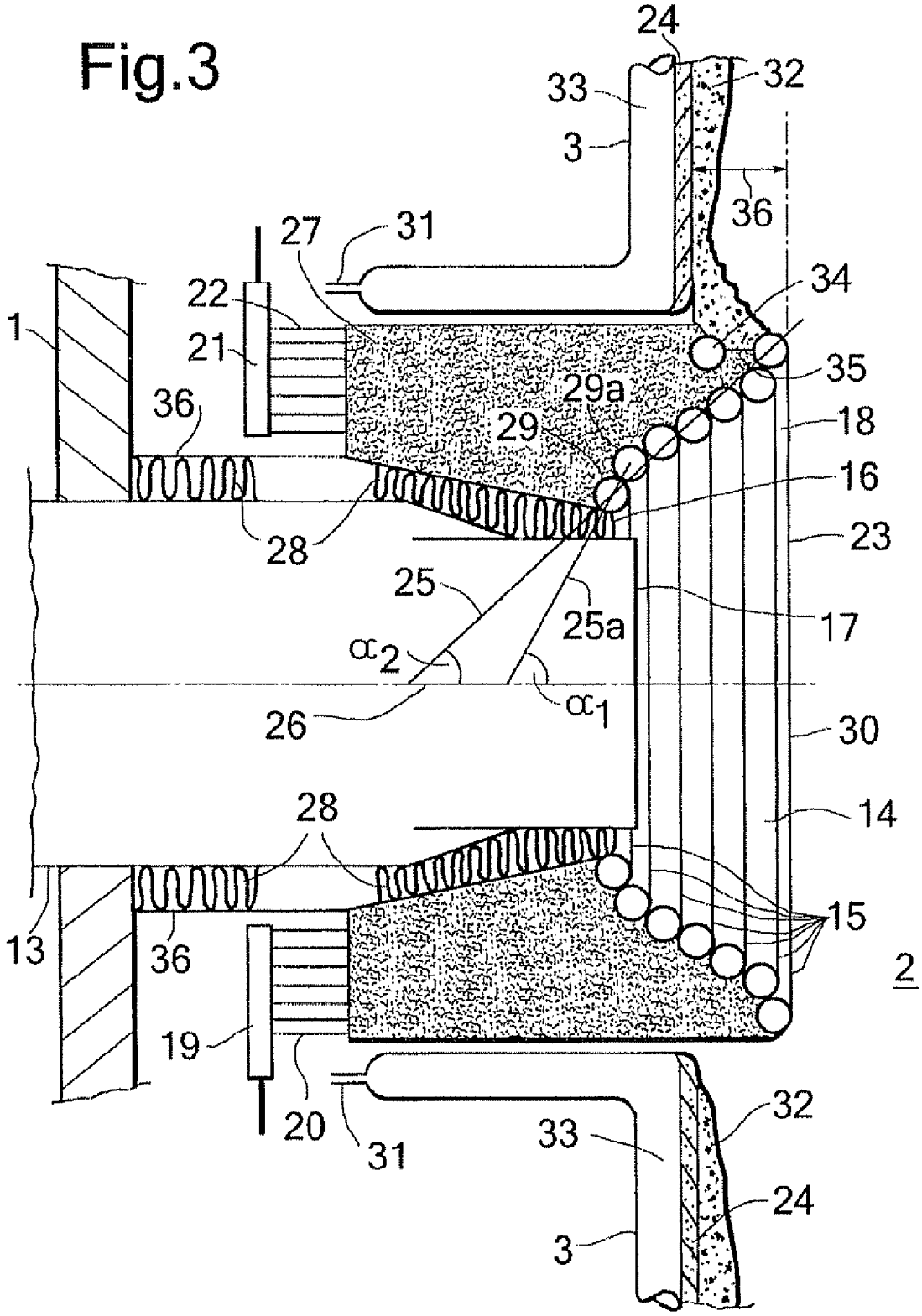
FIG. 3 is a detail of the reactor of FIG. 1 illustrating a preferred embodiment of the burner muffle.

The invention and its preferred embodiments will be further described by making use of FIGS. 1-3.

FIG. 1 shows a gasification reactor having a vertically oriented tubular pressure shell 1, a membrane wall 3 and a reaction zone 2. Part 3*a* of the membrane wall 3 is tubular shaped. The membrane wall 3 is composed of vertical conduits through which water flows. Water is supplied to the membrane wall via supply line 4 to a common distributor 5. The used cooling water, typically in the form of a water/steam mixture is discharged from the reactor via common header 6 and discharge line 7. The reactor is further provided with a quench gas supply 8, a discharge line 9 for the mixture of hydrogen and carbon monoxide as prepared in the gasification reactor and a discharge line 10 for slag. Two diametrically opposed burners 13 are shown. The reactor may comprise, for example, two or more pairs of such burners at the same elevation, or alternatively at different elevations. Suitable burners for a coal feed are for example described in U.S. Pat. No. 4,523,529 and U.S. Pat. No. 4,510,874. The burners are fed by a coal supply line 11 and a supply line 12 for oxygen.

FIG. 2 shows a burner 13 protruding into membrane wall 3. The muffle opening 16 for the burner head 17 is located between the pressure shell 1 and the membrane wall 3 as shown. Opening 18 is flush with membrane wall 3. In this design the burner muffle 14 therefore does not protrude into the reaction zone. Slag 32 can therefore easily enter opening 18 and fill the muffle 14 resulting in that the flame may deflect to the metallic muffle walls as explained above.

FIG. 3 illustrates a burner and burner muffle forming a part of a gasification reactor of FIG. 1 wherein the burner muffle 14 protrudes into the reaction zone 2. Applicants have found that such a protrusion is beneficial to prevent slag 32 from entering the burner muffle 14. It is believed that by preventing slag from depositing on the surface of the muffle 14 less local heat fluxes occur and thus an even more robust design is obtained. The slag 32 will, as a consequence of the protruded muffle 14, flow at the exterior of the outer positioned ring 30 downwards without being able to enter the muffle 14 itself.

Preferably the muffle 14 protrudes into the reaction zone 2 over a distance 36, which distance will depend on the ash properties and ash content in the feedstock. Distance 36 is at least one times the diameter of the rings 15 and more preferably at least two and not more than four times the diameter of the rings 15. The distance 36 is defined as the horizontal distance between the outer positioned ring 30 and the surface of the refractory 24 as shown.

In a more preferred embodiment as shown in FIG. 3 a muffle 14 is used having at its upper side a conduit 34 positioned such to form a slag gutter 35 along the upper part of the circumferential defined by opening 18 and outer ring 30. The conduit 34 has an inlet at one end for a cooling medium and an outlet for used cooling medium at its other end which are not shown.

FIGS. 2 and 3 further show a burner muffle 14 comprising several vertically oriented, concentric and interconnected rings 15. Preferably at least one or more and more preferably all rings 15 are conduits having individual inlets for a cooling medium via lines 20 and individual outlets for used cooling medium via lines 22. The thickness of the wall of the conduits is preferably as small as possible to allow for a good heat transfer and to limit the wall temperature. The minimum wall thickness will be determined by the mechanical strength as locally required. A skilled person can easily determine the correct dimensions for such a conduit. The diameter of the conduit is preferably between 0.02 and 0.05 m. The rings are preferably made from a low alloy steel with a Cr content up to 5 wt % or a high alloy steel with Cr content above 15 wt %.

Lines 20 and lines 22 are fluidly connected to cooling medium, typically water, distributor 19 and a common, typically water/steam mixture, header 21 respectively. The cooling water as supplied via lines 20 may be from the same source as the cooling water supplied to the conduit 33 of the membrane wall 3. It can be also from a different source, which may have a lower water temperature and/or a different pressure. The rings are preferably welded together.

Sequential rings 15 have an increasing diameter relative to neighbouring preceding rings 15 resulting in that the burner muffle 14 has a muffle opening 16 for the burner head 17 at one end and a larger opening 18 at its other—flame discharge—end 23. The muffle opening 16 is horizontally spaced away from the larger opening 18. This results in the connected rings having a cone-shaped form.

Preferably the angle $\alpha 1$ between the horizon 26 and the direct line 25*a* between the inner positioned ring 29 at the muffle opening 16 for the burner head 17 and the next ring 29*a*, adjacent to the inner ring 29, is between 15 and 60°. Preferably the angle $\alpha 2$ between the horizon 26 and the direct line 25 between the inner positioned ring 29 at the muffle opening 16 for the burner head 17 and the outer positioned ring 30 at the opening 18 at the flame discharge end 23 is between 20 and 70°. The line 25 is drawn from the centre of ring 29 to the centre of ring 30 as shown in FIG. 2. The line 25*a* is also drawn from the centre to the centre of the rings as shown. Preferably $\alpha 1$ is greater than $\alpha 2$. The outer positioned ring 30 is the ring that forms the muffle opening 16 for the burner head 17.

Preferably the number of rings 15 is between 6 and 10. The rings 15 may form a S-curve along line 25 as shown. Preferably a sealing 28 is present between the shaft of burner 13 and the burner sleeve 36. The sealing 28 can be extended to the burner head 17 as shown. Such a sealing 28 prevents gas and fly-ash and/or slag as present in the reaction zone from entering the burner sleeve 36 as present in the space between pressure shell 1 and membrane wall 3. By avoiding such a gas flow, local heat fluxes are further reduced. The sealing 28 is preferably a flexible sealing that can accommodate local thermal expansions. Examples of suitable sealing materials are fibre-woven and or knitted wire mesh type sealing.

FIGS. 2 and 3 also show part of the membrane wall 3. The membrane wall 3 will comprise several vertical and interconnected conduits 33 through which a cooling medium, preferably evaporating water, flows. Such conduits 33 are provided with supply and discharge lines 31 as schematically shown. The conduits 33 are preferably coated with refractory 24. In use the refractory 24 in turn will be covered by a layer of slag 32 as for example described in the afore-mentioned U.S. Pat. No. 4,959,080. FIGS. 2 and 3 also show a refractory mass 27 installed around the burner muffle 14, which prevents slag from entering the backside of the muffle 14 with a possible shortcut to the burner head 17.

What is claimed is:

1. A gasification reactor comprising a pressure shell, a reaction zone partly bounded by a vertically oriented tubular membrane wall, a horizontally directed burner having a burner head, said burner protruding into the vertical wall part of the membrane wall via a cone-shaped burner muffle, said burner muffle comprising several vertically oriented, concentric and interconnected rings, wherein successive rings have an increasing diameter relative to preceding neighbouring rings resulting in that the burner muffle has a muffle opening for the burner head at one end and a larger opening at its other—flame discharge—end, the rings comprising a conduit having an inlet end for a cooling medium and an outlet for used cooling medium and wherein the muffle opening for the burner head is located between the pressure shell and the membrane wall and wherein at least one ring of the burner muffle protrudes into the reaction zone.

2. A gasification reactor according to claim 1, wherein at the upper side of the part of the muffle which protrudes into the reaction zone a conduit is positioned to form a slag gutter and wherein the conduit has an inlet at one end for a cooling medium and an outlet for used cooling medium at its other end.

3. A gasification reactor according to claim 1, wherein the angle between the horizon and a direct line between the inner positioned ring at the muffle opening for the burner head and the outer positioned ring at the opening at the flame discharge end is between 20° and 70°.

4. A gasification reactor according to claim 1, wherein the angle between the horizon and the direct line between the inner positioned ring at the muffle opening for the burner head and the next ring, adjacent to the inner ring, is between 15 and 60°.

5. A gasification reactor according to claim 1, wherein the number of rings is between 6 and 10.

6. A gasification reactor according to claim 1, further comprising a sealing between the burner head and the inner ring.

7. A gasification reactor according to claim 6, wherein the sealing is a fibre woven or knitted wire mesh sealing.

8. A gasification reactor according to claim 1, wherein the rings are made from a low alloy steel with a Cr content up to 5 wt % or a high alloy steel with a Cr content above 15 wt %.

9. A gasification reactor according to claim 3, wherein the angle between the horizon and the direct line between the inner positioned ring at the muffle opening for the burner head and the next ring, adjacent to the inner ring, is between 15 and 60°.

* * * * *